US009066587B1

(12) United States Patent
Liang et al.

(10) Patent No.: US 9,066,587 B1
(45) Date of Patent: Jun. 30, 2015

(54) SLIDE RAIL SYSTEM AND CONNECTING DEVICE USED FOR SLIDE RAIL ASSEMBLY

(71) Applicants: KING SLIDE WORKS CO., LTD., Kaohsiung (TW); KING SLIDE TECHNOLOGY CO., LTD., Kaohsiung (TW)

(72) Inventors: Hsiu-Chiang Liang, Kaohsiung (TW); Ken-Ching Chen, Kaohsiung (TW); Chun-Chiang Wang, Kaohsiung (TW)

(73) Assignees: King Slide Works Co., Ltd., Kaohsiung (TW); King Slide Technology Co., Ltd., Kaohsiung (TW)

( * ) Notice: Subject to any disclaimer, the term of this patent is extended or adjusted under 35 U.S.C. 154(b) by 0 days.

(21) Appl. No.: 14/254,033

(22) Filed: Apr. 16, 2014

(51) Int. Cl.
*A47B 88/00* (2006.01)
*A47B 57/58* (2006.01)
*A47B 88/04* (2006.01)

(52) U.S. Cl.
CPC ..... *A47B 57/585* (2013.01); *A47B 88/0422* (2013.01); *A47B 88/0418* (2013.01); *A47B 2210/0054* (2013.01)

(58) Field of Classification Search
CPC ..... A47B 88/04; A47B 88/0418; A47B 88/0422; A47B 2210/0054
See application file for complete search history.

(56) References Cited

U.S. PATENT DOCUMENTS

| | | | | |
|---|---|---|---|---|
| 2007/0103043 | A1* | 5/2007 | Kropf et al. | 312/334.5 |
| 2009/0167128 | A1* | 7/2009 | Berger | 312/334.4 |
| 2012/0080988 | A1* | 4/2012 | Greussing | 312/334.6 |
| 2012/0176015 | A1* | 7/2012 | Liang et al. | 312/334.4 |
| 2012/0292465 | A1 | 11/2012 | Holzer et al. | |
| 2012/0319548 | A1* | 12/2012 | Netzer | 312/334.1 |
| 2014/0055021 | A1* | 2/2014 | Grabherr et al. | 312/334.8 |
| 2014/0346941 | A1* | 11/2014 | Gasser et al. | 312/334.1 |

* cited by examiner

*Primary Examiner* — Daniel Rohrhoff
(74) *Attorney, Agent, or Firm* — Rosenberg, Klein & Lee

(57) ABSTRACT

A slide rail assembly includes first and second rails. The second rail, slidable relative to the first rail, has a rear portion. A connecting device includes a main body containing a supporting portion and a transverse portion substantially perpendicularly connected to the supporting portion, a locking element pivotally connected to the supporting portion, and a movable element. When the locking element is rotated to a first position, a contact portion of a locking rod is pressed against the moveable element; once the locking element is rotated from the first position to a second position, the contact portion of the locking rod is no more pressed against the moveable element, thus allowing the movable element to be displaced relative to the main body.

9 Claims, 12 Drawing Sheets

SLIDE RAIL SYSTEM AND CONNECTING DEVICE USED FOR SLIDE RAIL ASSEMBLY

FIELD OF THE INVENTION

The present invention relates to slide rails and more particularly to a slide rail system and a connecting device used therein for connecting a slide rail assembly.

BACKGROUND OF THE INVENTION

Undermount drawer slides are a type of hidden slide rails. Typically, an undermount drawer slide is mounted on the bottom of a drawer so that, when the drawer is pulled out with respect to a frame (e.g., a cabinet), the undermount drawer slide stays hidden at the bottom of the drawer and is not exposed to view. Such an undermount drawer slide generally has an L-shaped bracket and a slide rail. The bracket is mounted on a wall surface of a cabinet, and the slide rail is arranged on the bracket and longitudinally slidable relative to the rail on the bracket. A drawer mounted on the slide rail can be pulled out with respect to the cabinet or pushed back into the cabinet via the slide rail.

However, due to minor errors in the mounting process or some external factors, the connecting device of the drawer may have problem being mounted to the slide rail.

To solve this problem, US Patent Application Publication No. 2012/0292465 A1, titled "Coupling device having side adjustment for a drawer", discloses a coupling device configured for a drawer and featuring transverse adjustability. The coupling device (5) serves mainly to detachably couple a drawer to an extendable rail. The relationship between the spiral disk (15) of the adjusting wheel (8) of the coupling device (5) and the tooth-shaped holding elements (21) of a mounting plate (16) is such that, when the adjusting wheel (8) is adjusted, the latching portion (10) of the coupling device (5) is driven, allowing abutment surfaces (10a, 10b, 10c) of the latching portion (10) to be adjusted in position relative to the carcass rail (3c) of an extension guide (3). In other words, the drawer (2) is transversely adjustable in position relative to the carcass rail (3c) of the extension guide (3) to eliminate minor mounting errors between the drawer and the carcass rail.

In addition, US Patent Application Publication No. 2012/0319548 A1, titled "Pull-out guide for a drawer", discloses in paragraph [0081], FIG. 2b, and FIG. 4 of its specification a holding element (5) mounted at the rear end of the extension rail (3a) of an extension guide (3). The holding element (5) has a holding nose (15) mounted in a bore of a drawer rear wall (2d). According to paragraphs [0082, 0083] and FIG. 5a of the specification, when a pivotal movement of an adjusting lever (18) is transmitted to lateral abutment surfaces of the holding element (5), a connecting element (7) and the holding nose (15) are displaced along a pair of guide bars (14). Therefore, the holding nose (15) of the extension rail (3a) can be adjusted in position relative to the drawer (2) in a transverse direction to eliminate mounting errors, which if existing may hinder installation of the drawer (2) on the holding nose (15) of the extension rail (3a). However, the numerous components of the holding element (5)—namely an adjustment device (11), a support element (17), a holding portion (19), and guide pins (14), in addition to the adjustment lever (18), the connecting element (7), and the holding nose (15) of the connecting element (7)—are to the disadvantage of the overall production cost and manufacturing process; in other words, the holding element (5) still leaves room for improvement.

SUMMARY OF THE INVENTION

The present invention relates to a slide rail system which allows the connecting position of a drawer to be adjusted relative to a slide rail in a transverse direction. The present invention also relates to a connecting device used in the slide rail system to connect a slide rail assembly.

According to one aspect of the present invention, a slide rail system includes a slide rail assembly and a rear connecting device. The slide rail assembly includes a first rail and a second rail. The first rail has a longitudinally extending main body. The second rail is longitudinally slidable relative to the first rail. The second rail has a longitudinally extending main body and a rear portion. The rear connecting device is provided on the rear portion of the second rail and includes a main body, a locking element, and a movable element. The main body of rear connecting device includes a supporting portion and a transverse portion substantially perpendicularly connected to the supporting portion. The locking element is pivotally connected to the supporting portion of the main body and includes a head and a locking rod connected to the head. The locking rod has a contact portion. The movable element is movably provided between the main body and the locking element. The movable element includes a first plate portion and a second plate portion substantially perpendicular to the first plate portion. When the head of the locking element is rotated to a first position, the contact portion of the locking rod is pressed against the first plate portion of the movable element such that the movable element is positioned on the main body. Once the head of the locking element is rotated from the first position to a second position, the contact portion of the locking rod is no more pressed against the first plate portion of the movable element, and the movable element is therefore allowed to be displaced relative to the main body.

Preferably, the supporting portion of the main body of the rear connecting device includes a first vertical wall and a second vertical wall, and the transverse portion of the main body of the rear connecting device has two opposite lateral sides respectively and substantially perpendicularly connected to the first vertical wall and the second vertical wall. Each of the first vertical wall and the second vertical wall has a through hole, and the through holes correspond in position to each other. The locking rod of the locking element extends through the through holes of the first vertical wall and the second vertical wall. The movable element preferably has a width less than a width between the first vertical wall and the second vertical wall so that the movable element can be displaced between the first vertical wall and the second vertical wall.

Preferably, the transverse portion of the main body of the rear connecting device includes a plurality of fixing portions which are arranged at intervals, and the first plate portion of the movable element includes a fixing portion corresponding in position to one of the fixing portions of the transverse portion of the main body of the rear connecting device. When the head of the locking element is rotated to the first position, the contact portion of the locking rod is pressed against the first plate portion of the movable element such that the fixing portion of the first plate portion of the movable element is engaged with one of the fixing portions of the transverse portion of the main body of the rear connecting device. Once the head of the locking element is rotated from the first position to the second position, the contact portion of the locking rod is no more pressed against the first plate portion of the movable element, and the fixing portion of the first plate portion of the movable element is therefore disengaged from the one of the fixing portions of the transverse portion of the main body of the rear connecting device.

Preferably, the second rail further has a front portion opposite the rear portion and a mounting hole adjacent to the front portion, and the slide rail system further includes a front connecting device. The front connecting device includes a first unit, a second unit, an engaging element, and an adjusting element. The first unit has at least one transverse guiding portion. The second unit has at least one transverse guiding portion located at the transverse guiding portion of the first unit. The engaging element is connected to the second unit and has an engaging portion. At least a portion of the engaging portion is located in the mounting hole of the second rail. The adjusting element has an adjusting portion and a screw rod. The screw rod is connected to the first unit and the second unit. The second unit is displaceable relative to the second rail in response to rotation of the adjusting portion of the adjusting element so that the engaging portion of the engaging element can be displaced relative to the mounting hole of the second rail. Preferably, the second unit further includes a first sidewall with a hanging hole, and the first unit further includes a sidewall with a threaded hole. The screw rod of the adjusting element is threadedly connected to the threaded hole while the second unit hangs on a neck of the screw rod via the hanging hole. The second unit preferably further includes a second sidewall which is opposite the first sidewall and which has a wall hole. The engaging portion of the engaging element corresponds in position to the wall hole. Preferably, the engaging element further includes an elastic arm. When the adjusting portion of the adjusting element is rotated, the second unit is displaced relative to the second rail, the engaging portion of the engaging element if not yet corresponding in position to the mounting hole of the second rail is pressed against a sidewall of the second rail and pivoted by a predetermined angle such that the elastic arm stores an elastic energy, and the engaging portion of the engaging element, once corresponding in position to the mounting hole, enters the mounting hole due to the elastic energy released by the elastic arm. Preferably, the engaging element further includes a slot, and the front connecting device further includes a disengaging element pivotally connected to the second unit. The disengaging element has a disengaging portion located in the slot. When the disengaging element is pivoted, the disengaging portion of the disengaging element drives the engaging element via the slot and thereby pivots the engaging element; consequently, the engaging portion of the engaging element is displaced relative to the second rail and separates from the mounting hole.

According to another aspect of the present invention, a connecting device includes a main body, a locking element, and a movable element. The main body includes a supporting portion and a transverse portion substantially perpendicularly connected to the supporting portion. The locking element is pivotally connected to the supporting portion of the main body and includes a head and a locking rod connected to the head. The locking rod has a contact portion. The movable element is movably provided between the main body and the locking element. The movable element includes a first plate portion and a second plate portion substantially perpendicular to the first plate portion. When the head of the locking element is rotated to a first position, the contact portion of the locking rod is pressed against the first plate portion of the movable element such that the movable element is positioned on the main body. Once the head of the locking element is rotated from the first position to a second position, the contact portion of the locking rod is no more pressed against the first plate portion of the movable element, and the movable element is therefore allowed to be displaced relative to the main body.

Preferably, the supporting portion of the main body of the connecting device includes a first vertical wall and a second vertical wall, and the transverse portion of the main body of the connecting device has two opposite lateral sides respectively and substantially perpendicularly connected to the first vertical wall and the second vertical wall. Each of the first vertical wall and the second vertical wall has a through hole, and the through holes correspond in position to each other. The locking rod of the locking element extends through the through holes of the first vertical wall and the second vertical wall. The movable element preferably has a width less than a width between the first vertical wall and the second vertical wall so that the movable element can be displaced between the first vertical wall and the second vertical wall.

Preferably, the transverse portion of the main body of the connecting device includes a plurality of fixing portions which are arranged at intervals, and the first plate portion of the movable element includes a fixing portion corresponding in position to one of the fixing portions of the transverse portion of the main body of the connecting device. When the head of the locking element is rotated to the first position, the contact portion of the locking rod is pressed against the first plate portion of the movable element such that the fixing portion of the first plate portion of the movable element is engaged with one of the fixing portions of the transverse portion of the main body of the connecting device. Once the head of the locking element is rotated from the first position to the second position, the contact portion of the locking rod is no more pressed against the first plate portion of the movable element, and the fixing portion of the first plate portion of the movable element is therefore disengaged from the one of the fixing portions of the transverse portion of the main body of the connecting device.

One technical feature of the embodiments of the present invention is that the locking element of the rear connecting device makes it possible for an operator to adjust the mounting position of the slide rail assembly with which the drawer is to align. Another technical feature is that the operator can adjust the connecting position of a drawer with respect to the slide rail assembly in a transverse direction by means of the adjusting element of the front connecting device.

BRIEF DESCRIPTION OF THE DRAWINGS

The invention as well as a preferred mode of use and the advantages thereof will be best understood by referring to the following detailed description of some illustrative embodiments in conjunction with the accompanying drawings, wherein.

DETAILED DESCRIPTION OF THE INVENTION

Figure 1:
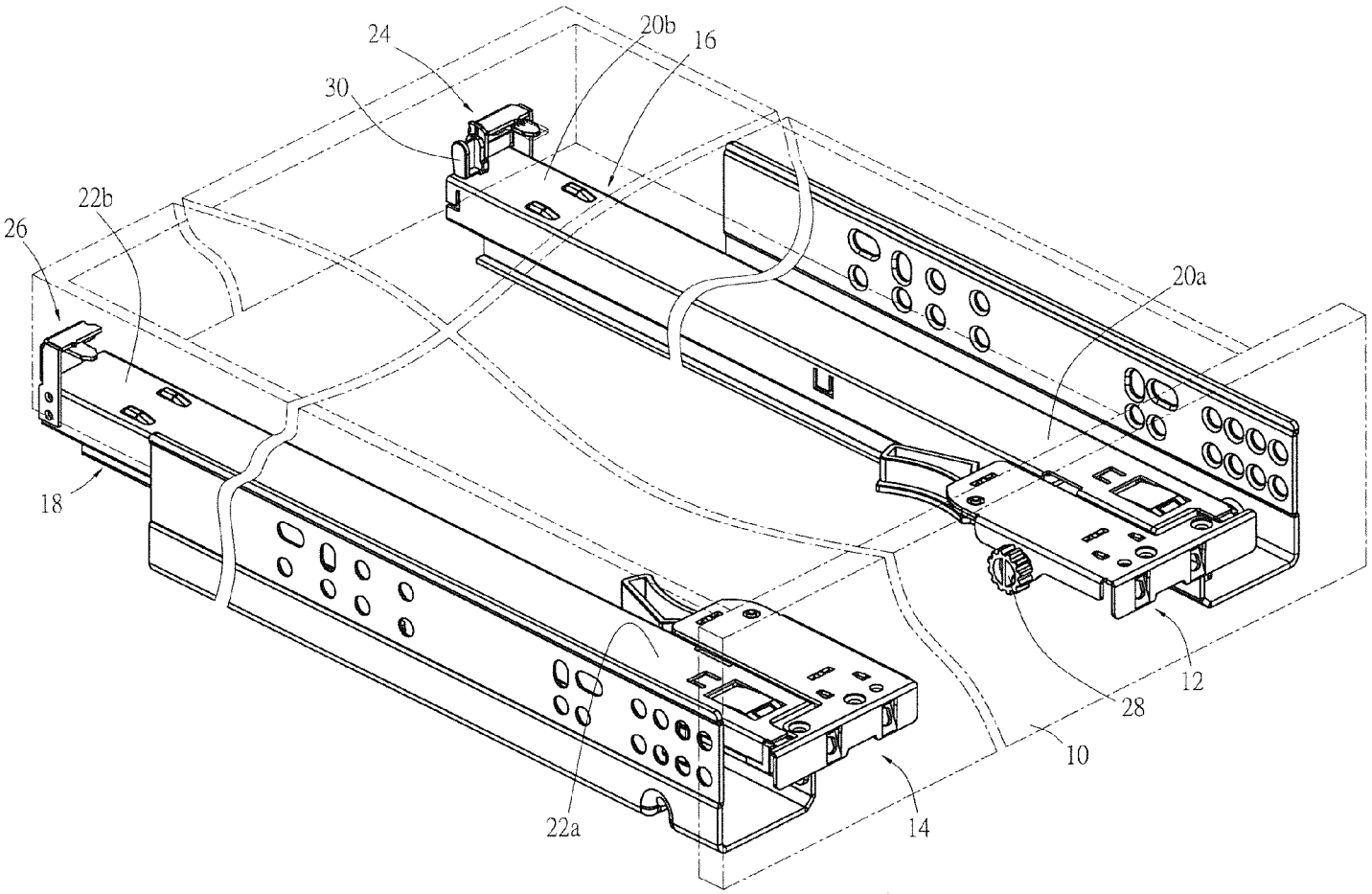
FIG. 1 is an assembled perspective view showing how a drawer is mounted on slide rail assemblies by means of connecting devices according to an embodiment of the present invention.

FIG. 1 shows how a drawer 10 is mounted on a first slide rail assembly 16 and a second slide rail assembly 18 by means of a first front connecting device 12 and a second front connecting device 14. The first slide rail assembly 16 includes a front portion 20*a* and a rear portion 20*b* opposite the front portion 20*a*. The second slide rail assembly 18 includes a front portion 22*a* and a rear portion 22*b* opposite the front portion 22*a*.

More specifically, the first front connecting device 12 and the second front connecting device 14 are respectively arranged on two lateral sides of the bottom of the drawer 10. The first front connecting device 12 is mounted at the front portion 20*a* of the first slide rail assembly 16, and the second front connecting device 14 is mounted at the front portion 22*a* of the second slide rail assembly 18. In addition, the rear portion 20*b* of the first slide rail assembly 16 is mounted with a first rear connecting device 24, and the rear portion 22*b* of the second slide rail assembly 18 is mounted with a second rear connecting device 26.

In one preferred embodiment, one of the first rear connecting device 24 and the second rear connecting device 26 has a locking element 30. With the locking element 30, an operator can adjust the mounting position of the corresponding slide rail assembly (e.g., the first slide rail assembly 16 or the second slide rail assembly 18) with which the drawer 10 is to align. Also, one of the first front connecting device 12 and the second front connecting device 14 has an adjusting element 28. With the adjusting element 28, the operator can adjust the connecting position of the drawer 10 relative to the corresponding slide rail assembly (e.g., the first slide rail assembly 16 or the second slide rail assembly 18) in a transverse direction.

In practice, only one of the slide rail assemblies (e.g., the first slide rail assembly 16 or the second slide rail assembly 18) is required to be equipped with the front connecting device and the rear connecting device to achieve the aforesaid effects.

Figures 2A, 2B:
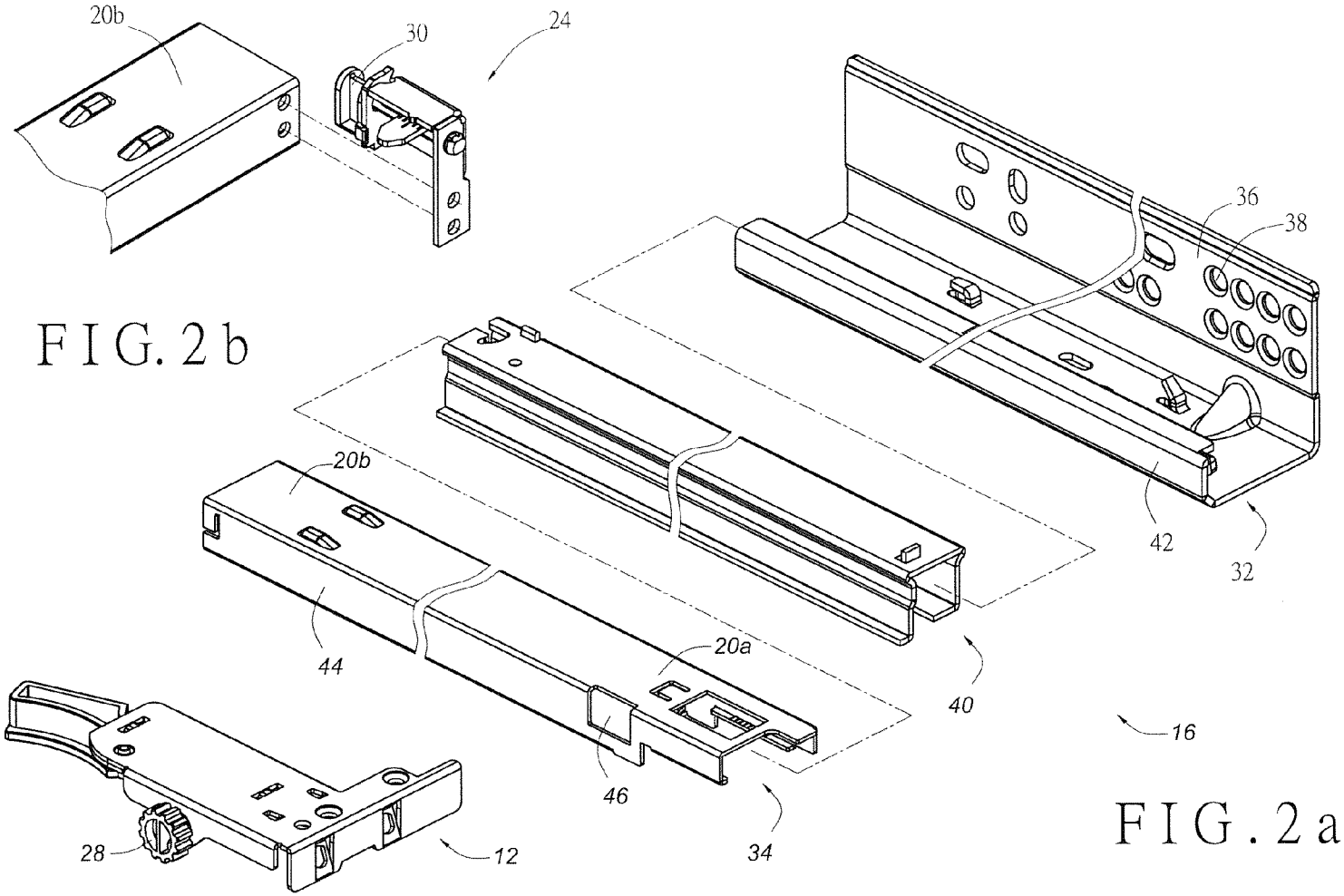
FIG. 2*a* is an exploded perspective view of the slide rail assembly and front connecting device on a single side of FIG. 1.
FIG. 2*b* is an exploded perspective view of the rear connecting device and second rail (only a rear portion thereof is shown) on a single side of FIG. 1.

The first slide rail assembly 16 is now described in more detail with reference to FIG. 2*a* and FIG. 2*b*. The first slide rail assembly 16 includes a first rail 32 and a second rail 34. The first rail 32 has a wall portion 36 provided with at least one positioning hole 38 so that the first rail 32 can be mounted to a frame (e.g., a cabinet) by passing a fastener (not shown) through the positioning hole 38.

In one preferred embodiment, a third rail 40 is further provided between the first rail 32 and the second rail 34. The third rail 40 is configured to extend the sliding distance of the second rail 34 relative to the first rail 32, thus allowing the drawer 10 to be displaced farther from the frame. In practice, however, the third rail 40 is optional, meaning that the first rail 32 and the second rail 34 alone are sufficient to enable displacement of the drawer 10 relative to the frame.

More specifically, the first rail 32 has a longitudinally extending main body 42. The second rail 34 can slide longitudinally relative to the first rail 32. The second rail 34 has a longitudinally extending main body 44, the front portion 20*a*, the rear portion 20*b* opposite the front portion 20*a*, and a mounting hole 46 adjacent to the front portion 20*a*.

The first front connecting device 12, which includes the aforesaid adjusting element 28, is connected to the second rail 34 via the mounting hole 46. The first rear connecting device 24, which includes the aforesaid locking element 30, is arranged at the rear portion 20*b* of the second rail 34.

Figure 3:
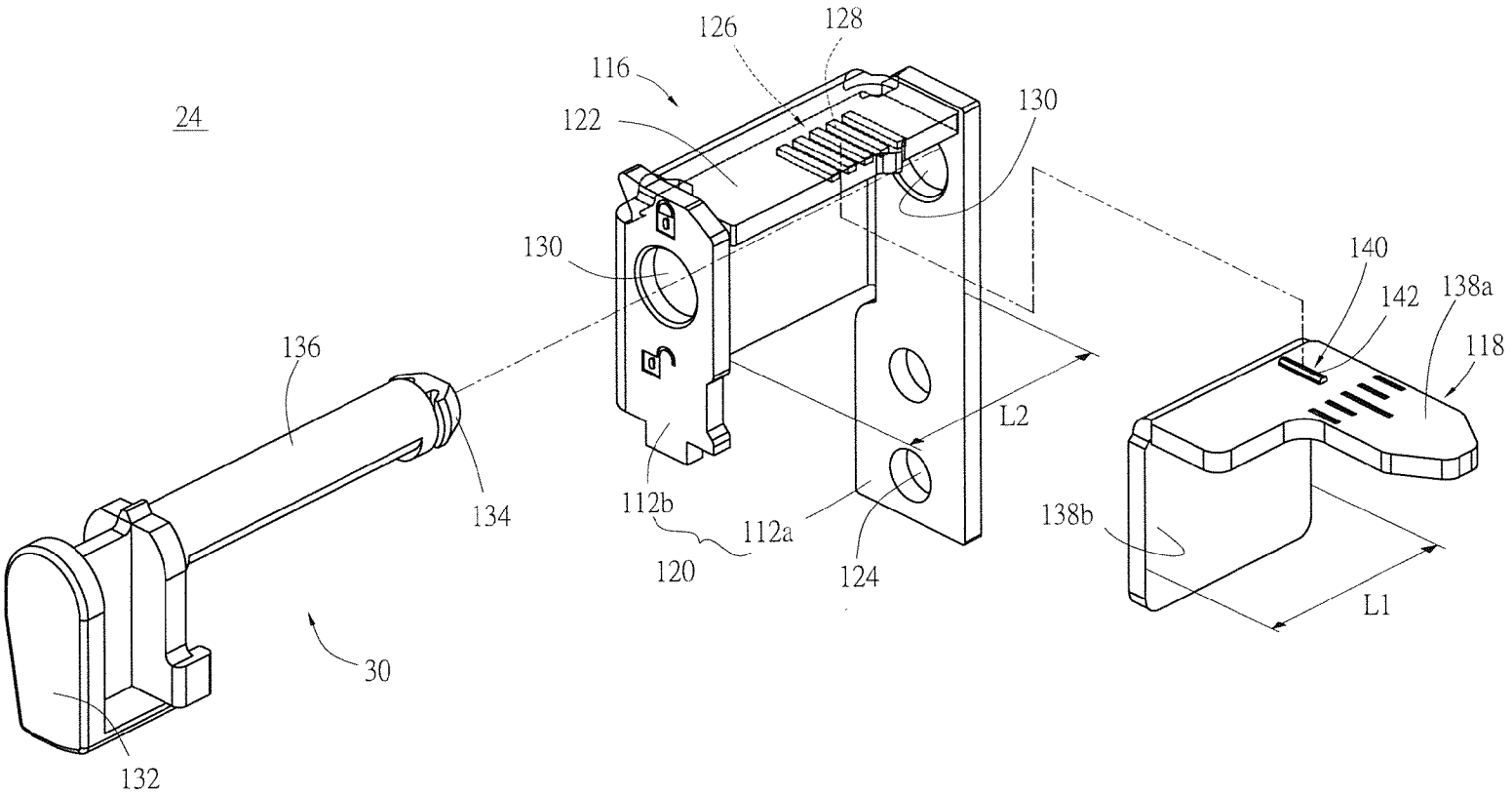
FIG. 3 is an exploded perspective view of an embodiment of the rear connecting device in the present invention.

As shown in FIG. 3, the first rear connecting device 24 includes a main body 116 and a movable element 118 in addition to the locking element 30.

The main body 116 includes a supporting portion 120 and a transverse portion 122 substantially perpendicularly connected to the supporting portion 120. In one preferred embodiment, the supporting portion 120 of the main body 116 includes a first vertical wall 112*a* and a second vertical wall 112*b*. The first vertical wall 112*a* and the second vertical wall 112*b* are respectively and substantially perpendicularly connected to two opposite lateral sides of the transverse portion 122 of the main body 116. The first rear connecting device 24 includes at least one connecting hole 124 through which a connecting element (not shown) is passed to mount the first rear connecting device 24 to the rear portion 20*b* of the second rail 34 of the first slide rail assembly 16 (see FIG. 1). Alternatively, the first rear connecting device 24 may be integrally formed with the rear portion 20*b* of the second rail 34 of the first slide rail assembly 16.

In one preferred embodiment, the transverse portion 122 of the main body 116 includes a plurality of fixing portions 126 which are arranged at intervals. Each fixing portion 126 of the transverse portion 122 of the main body 116 is a recess 128. In addition, each of the first vertical wall 112*a* and the second vertical wall 112*b* has a through hole 130, and the through holes 130 correspond in position to each other.

The locking element 30 is pivotally connected to the supporting portion 120 of the main body 116. The locking element 30 includes a head 132 and a locking rod 134 connected to the head 132, wherein the locking rod 134 has a contact portion 136. The locking rod 134 of the locking element 30 is pivotally provided in the through holes 130 of the first vertical wall 112*a* and the second vertical wall 112*b*.

The movable element 118 is movably provided between the main body 116 and the locking element 30. The movable element 118 includes a first plate portion 138*a* and a second plate portion 138*b* perpendicular to the first plate portion 138*a*.

Preferably, the first plate portion 138*a* of the movable element 118 includes a fixing portion 140 corresponding in position to one of the fixing portions 126 of the transverse portion 122 of the main body 116. The fixing portion 140 of the first plate portion 138*a* is a rib 142 corresponding in structure to each recess 128 in the transverse portion 122 of the main body 116. Moreover, the movable element 118 has a width L1 less than a width L2 between the first vertical wall 112*a* and the second vertical wall 112*b* of the main body 116. This allows the movable element 118 to move between the first vertical wall 112*a* and the second vertical wall 112*b* of the main body 116.

Figure 4B:
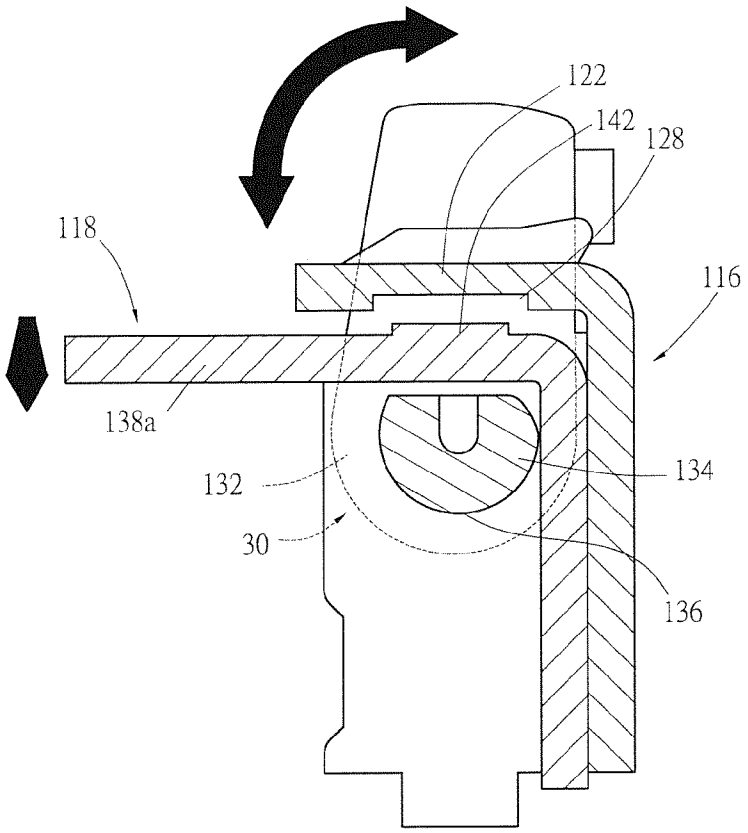
FIG. 4*b* is another schematic drawing showing operation of the rear connecting device in FIG. 3 after assembly.
Figure 4A:
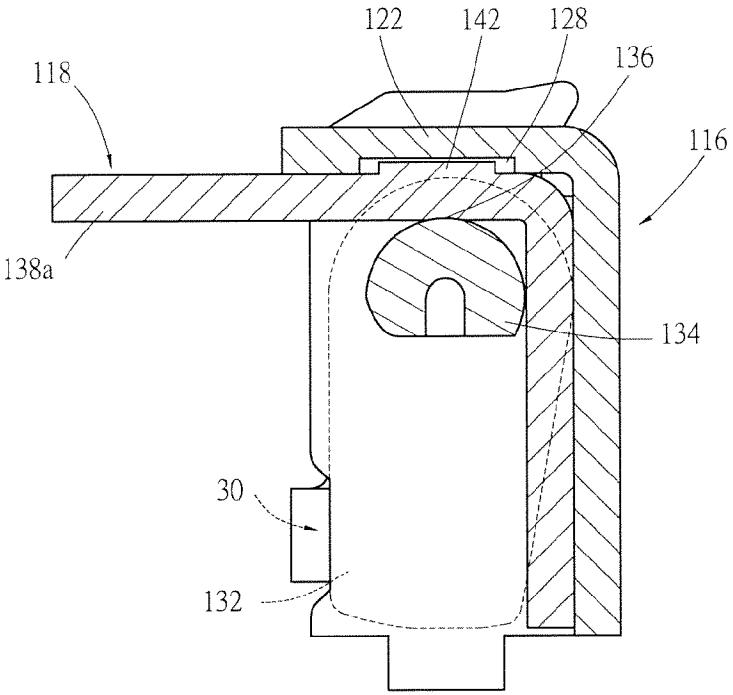
FIG. 4*a* is a schematic drawing showing operation of the rear connecting device in FIG. 3 after assembly.

Referring to FIG. 4*a*, when the head 132 of the locking element 30 is rotated to a first position, the contact portion 136 of the locking rod 134 of the locking element 30 is pressed against the first plate portion 138*a* of the movable element 118 such that the rib 142 of the first plate portion 138*a* of the movable element 118 is engaged in one of the recesses 128 of the transverse portion 122 of the main body 116. It can be known from the above that, by means of the locking element 30, the first plate portion 138*a* of the movable element 118 can be fixed at the mounting position to enable alignment of the drawer 10 (see FIG. 1), i.e., allowing the back panel of the drawer 10 to align with and be mounted to the first plate portion 138*a*.

Figure 5:
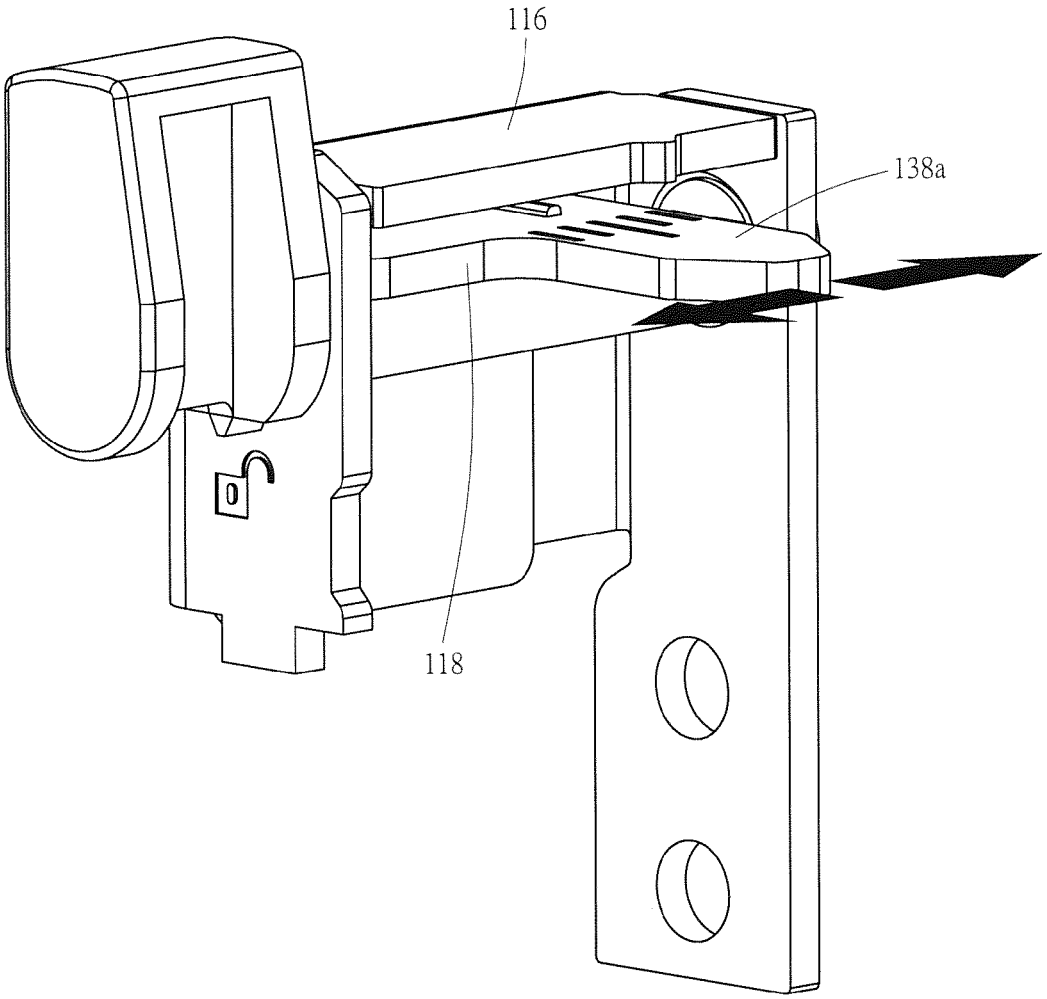
FIG. 5 schematically shows how the movable element of the rear connecting device in FIG. 3 can be adjusted in position.

Referring to FIG. 4*b*, when mounting errors prevent the drawer 10 from being aligned with the first plate portion 138*a* of the movable element 118, the operator can rotate the head 132 of the locking element 30 from the first position to a second position so that the contact portion 136 of the locking rod 134 of the locking element 30 is no longer pressed against the first plate portion 138*a* of the movable element 118. This allows the rib 142 of the first plate portion 138*a* of the movable element 118 to disengage from the one of the recesses 128 of the transverse portion 122 of the main body 116, and consequently the movable element 118 to displace relative to the main body 116. As shown in FIG. 5, the movable element 118, which includes the first plate portion 138*a*, can be adjusted in position to adapt to mounting errors between the drawer 10 and the first plate portion 138*a* of the movable element 118, thereby eliminating the difficulty of alignment therebetween.

Figure 6:
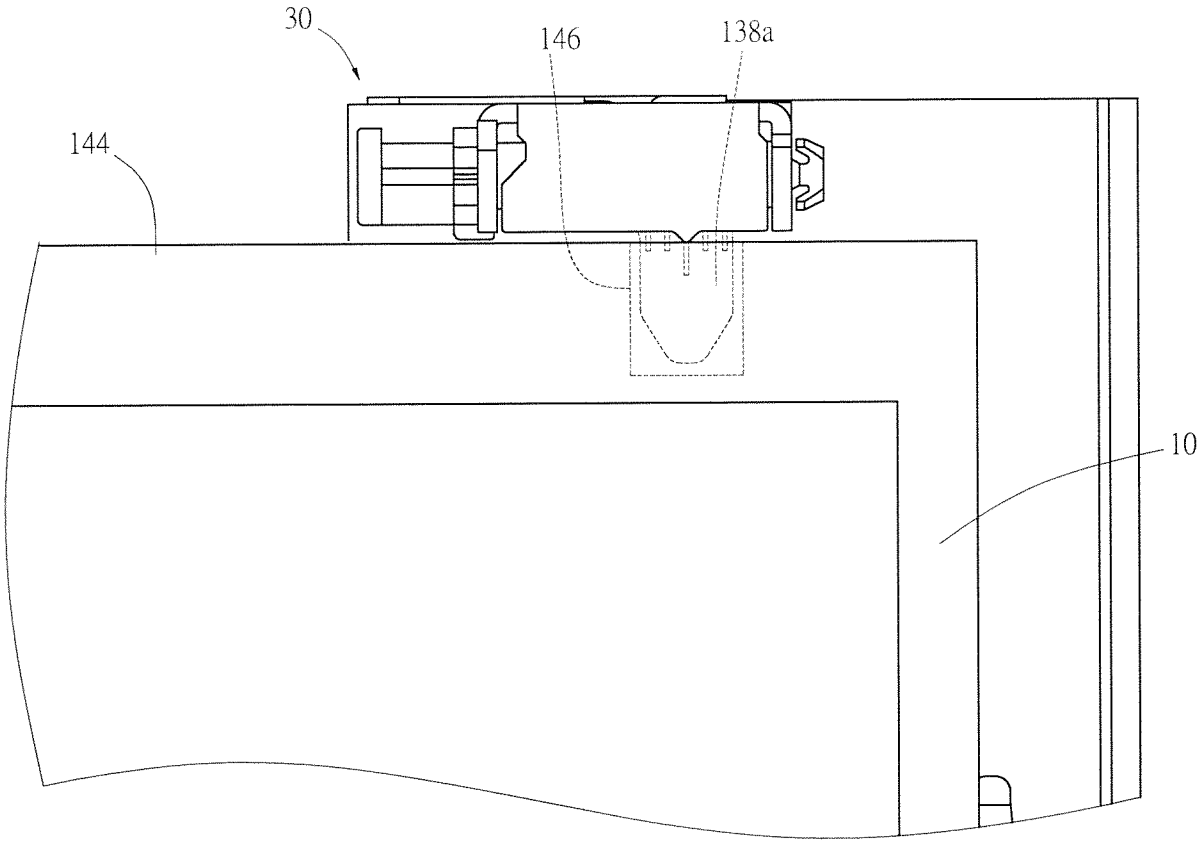
FIG. 6 schematically shows how the first plate portion of the movable element in an embodiment of the present invention is aligned with a positioning hole in the back panel of a drawer.

Referring to FIG. 6, once the position of a positioning hole 146 in the back panel 144 of the drawer 10 is determined, the operator can operate the locking element 30 so that, by adjusting the position of the movable element 118, which includes the first plate portion 138*a*, the first plate portion 138*a* is aligned with the positioning hole 146 in the back panel 144 of the drawer 10 to eliminate mounting errors between the back panel 144 of the drawer 10 and the first plate portion 138*a* of the movable element 118.

Figure 7B:
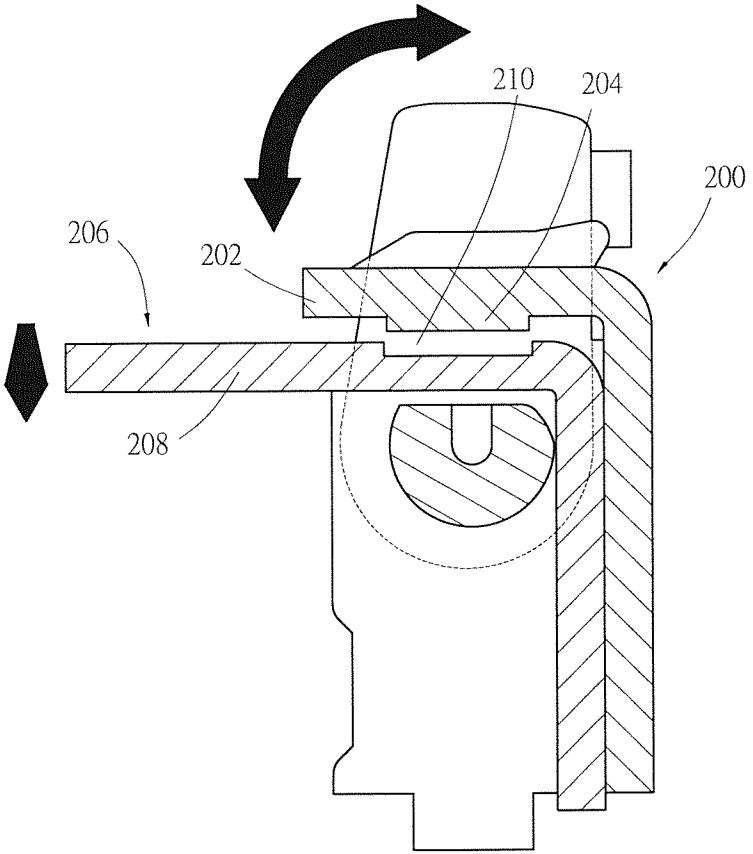
FIG. 7*b* is another schematic drawing showing operation of the second embodiment of the rear connecting device in the present invention.
Figure 7A:
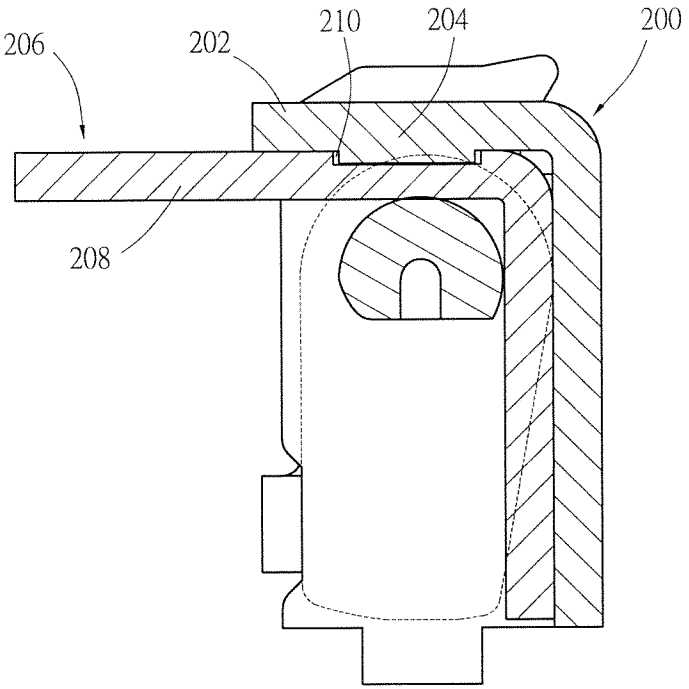
FIG. 7*a* is a schematic drawing showing operation of the second embodiment of the rear connecting device in the present invention.

FIG. 7*a* and FIG. 7*b* show the second embodiment of the rear connecting device. This embodiment is different from the embodiment in FIG. 4*a* and FIG. 4*b* only in that each fixing portion of the transverse portion 202 of the main body 200 is a rib 204, and that the fixing portion of the first plate portion 208 of the movable element 206 is a recess 210. As the second embodiment has the same technical effects as the embodiment in FIG. 4*a* and FIG. 4*b*, further description is omitted here for brevity.

Figure 8B:
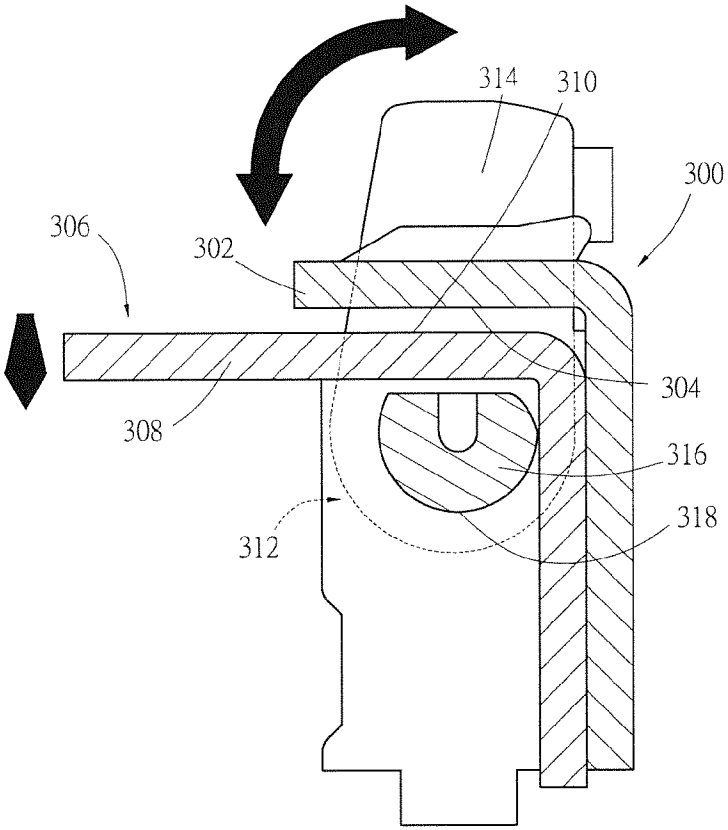
FIG. 8*b* is another schematic drawing showing operation of the third embodiment of the rear connecting device in the present invention.
Figure 8A:
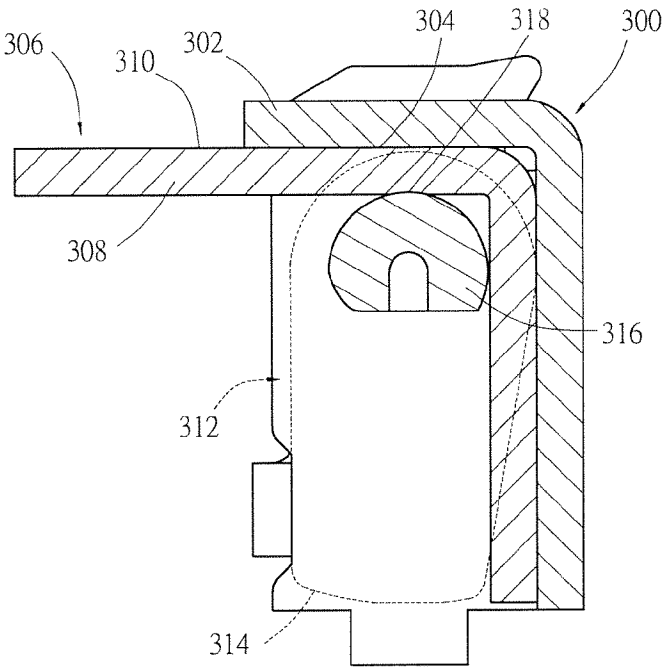
FIG. 8*a* is a schematic drawing showing operation of the third embodiment of the rear connecting device in the present invention.

FIG. 8*a* and FIG. 8*b* show the third embodiment of the rear connecting device. This embodiment is different from the embodiments in FIGS. 4*a*, 4*b* and FIGS. 7*a*, 7*b* only in that each fixing portion 304 of the transverse portion 302 of the main body 300 is a flat surface (without any rib or recess), and that the fixing portion 310 of the first plate portion 308 of the movable element 306 is also a flat surface (without any rib or recess). The third embodiment has substantially the same technical effects as the embodiments in FIGS. 4*a*, 4*b* and FIGS. 7*a*, 7*b*.

More specifically, referring to FIG. 8*a*, when the head 314 of the locking element 312 is rotated to a first position, the contact portion 318 of the locking rod 316 is pressed against the first plate portion 308 of the movable element 306; as a result, the movable element 306 is fixed to the main body 300 by friction. Referring to FIG. 8*b*, once the head 314 of the locking element 312 is rotated from the first position to a second position, the contact portion 318 of the locking rod 316 is no more pressed against the first plate portion 308 of the movable element 306, and the movable element 306 is therefore allowed to displace relative to the main body 300.

Figure 9:
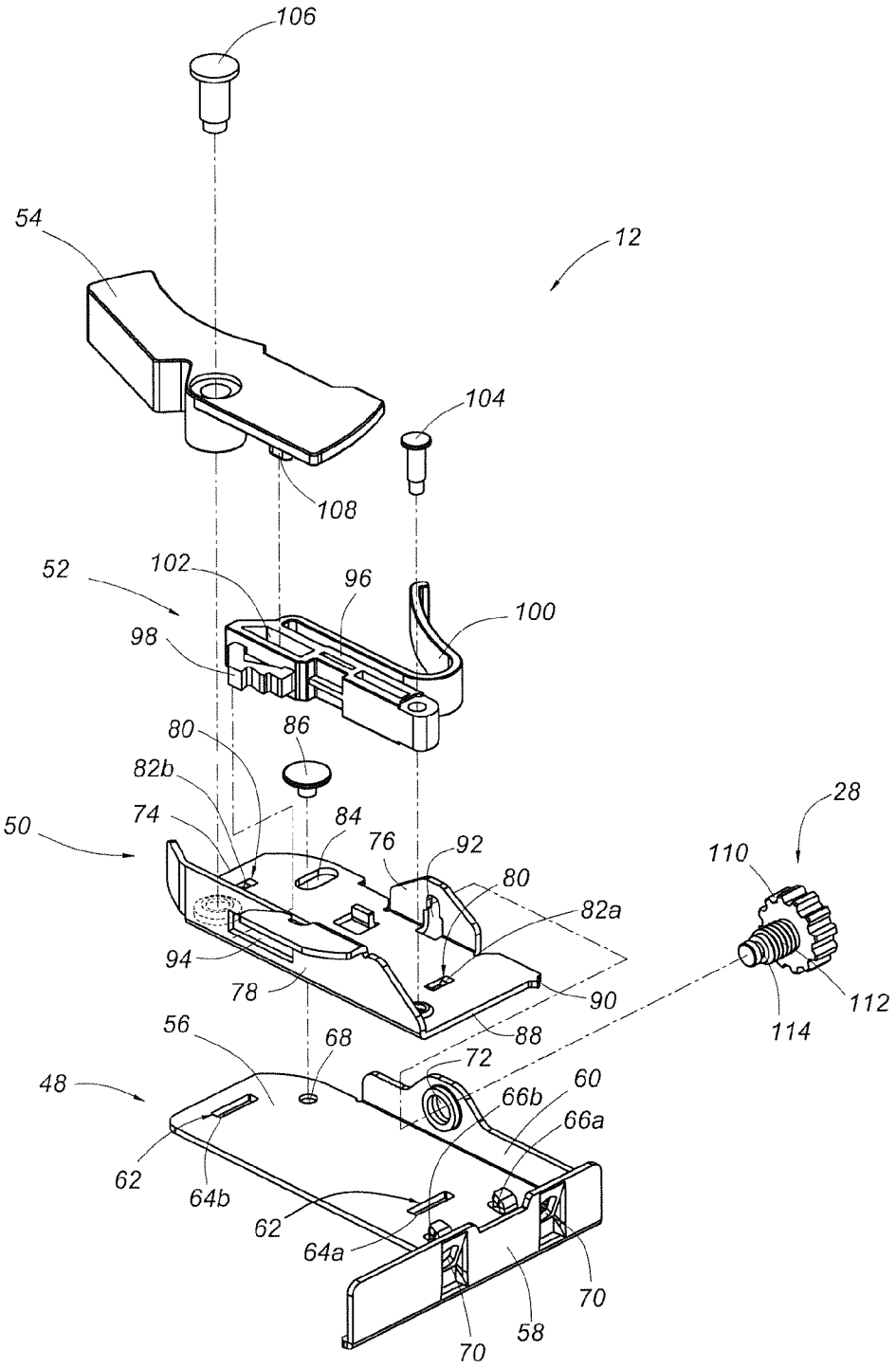
FIG. 9 is an exploded perspective view of the first front connecting device in FIG. 1.
Figure 10B:
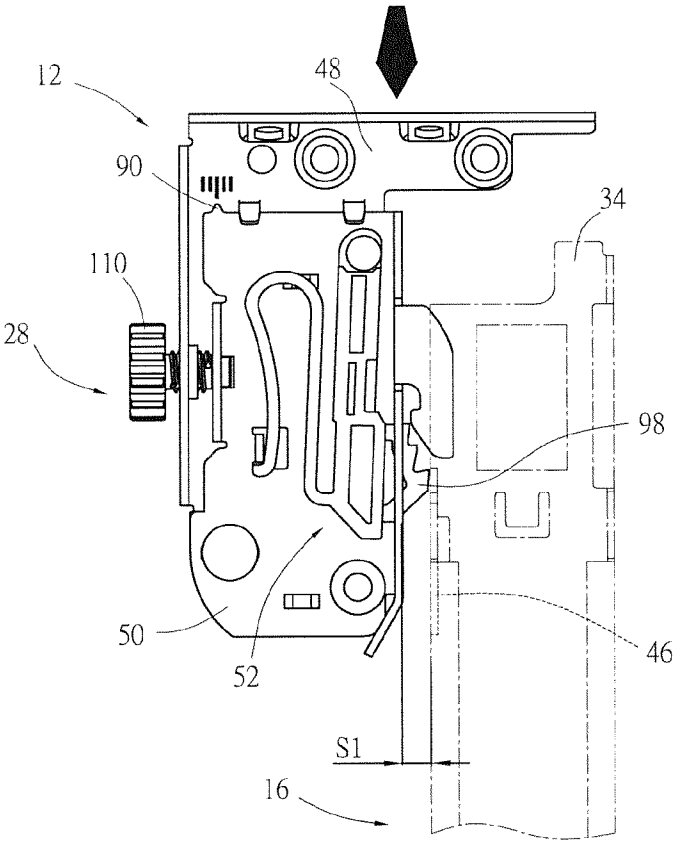
FIG. 10*b* is another schematic drawing in which mounting errors between the engaging portion of the front connecting device and a mounting hole of the slide rail assembly prevent the front connecting device from being properly connected to the mounting hole in the second rail of the slide rail assembly.
Figure 10A:
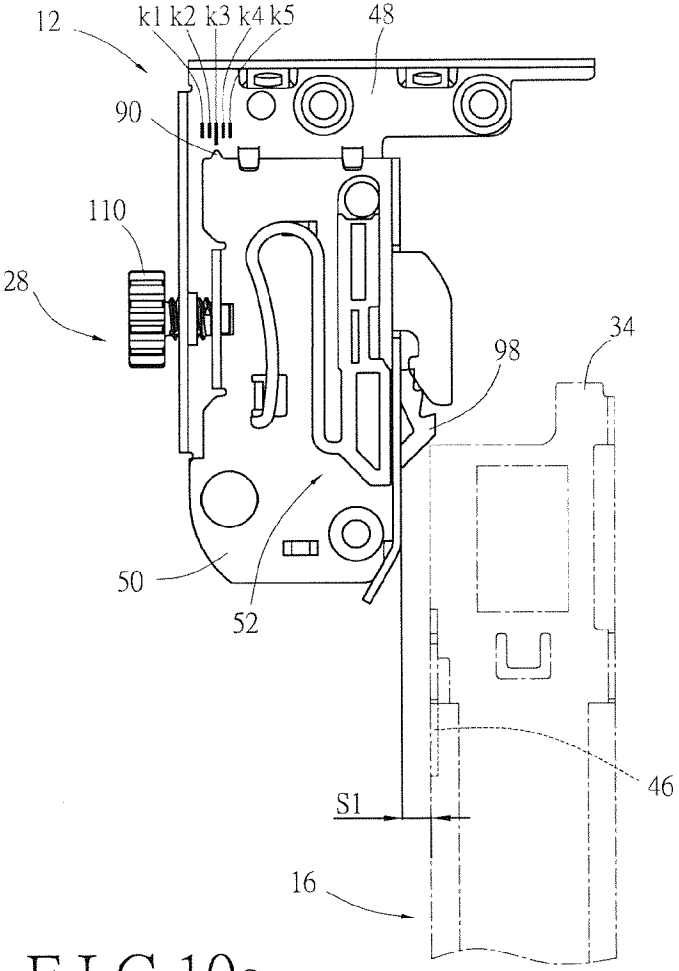
FIG. 10*a* is a schematic drawing in which mounting errors between the engaging portion of the front connecting device and a mounting hole of the slide rail assembly prevent the front connecting device from being properly connected to the mounting hole in the second rail of the slide rail assembly.

Referring to FIG. 9 and FIG. 10*a*, the first front connecting device 12 includes a first unit 48, a second unit 50, an engaging element 52, and a disengaging element 54, in addition to the adjusting element 28.

The first unit 48 includes a main body 56, a front wall 58 located at a front portion of the main body 56, and a sidewall 60 located at a lateral side of the main body 56.

The main body 56 of the first unit 48 has at least one transverse guiding portion 62 which is substantially parallel to the front wall 58. The at least one transverse guiding portion 62 of the first unit 48 may be formed as one or more transverse guiding holes. Here, the at least one transverse guiding portion 62 of the first unit 48 is implemented by a first transverse guiding hole 64*a* and a second transverse guiding hole 64*b* by way of example. In an embodiment which is not shown, however, the at least one transverse guiding portion 62 of the first unit 48 is one or more protruding blocks. It should be noted that the "transverse" direction refers to a direction perpendicular to the longitudinally extending main body 42 of the first rail 32 or the longitudinally extending main body 44 of the second rail 34.

In one preferred embodiment, the main body 56 of the first unit 48 further includes at least one transverse guiding groove between the first transverse guiding hole 64*a* and the front wall 58. Here, the at least one transverse guiding groove is implemented by a first transverse guiding groove 66*a* and a second transverse guiding groove 66*b*, wherein the first transverse guiding groove 66*a* and the second transverse guiding groove 66*b* are arranged substantially in a line. In addition, the main body 56 of the first unit 48 is provided with an aperture 68 between the first transverse guiding hole 64*a* and the second transverse guiding hole 64*b*. Moreover, the front wall 58 of the first unit 48 is provided with a mounting portion (e.g., mounting holes 70) which, together with a mounting element (not shown), allows the first unit 48 to be mounted to the drawer 10, and yet the mounting method of the first unit 48 is not limited to the above. The sidewall 60 of the first unit 48 includes a threaded hole 72.

The second unit 50 includes a main body 74, a first sidewall 76 located at a lateral side of the main body 74, and a second sidewall 78 located at the opposite lateral side of the main body 74 and facing the first sidewall 76.

The main body 74 of the second unit 50 corresponds in position to the main body 56 of the first unit 48. The main body 74 of the second unit 50 has at least one transverse guiding portion 80 corresponding in position to and located at the transverse guiding portion 62 of the first unit 48 so as to be guided by the transverse guiding portion 62 of the first unit 48. Here, the at least one transverse guiding portion 80 of the second unit 50 is implemented by a first protruding block 82*a* and a second protruding block 82*b* by way of example. Thus, with the first protruding block 82*a* and the second protruding block 82*b* of the second unit 50 corresponding in position to the first transverse guiding hole 64*a* and the second transverse guiding hole 64*b* of the first unit 48 respectively, the second unit 50 can slide smoothly relative to the first unit 48. In an embodiment which is not shown, however, the at least one transverse guiding portion 80 of the second unit 50 is one or more transverse guiding holes corresponding in position to one or more protruding blocks (i.e., the at least one transverse guiding portion 62) of the first unit 48.

In one preferred embodiment, the main body 74 of the second unit 50 further includes a transverse hole 84 whose dimensions, in particular the transverse width, are greater than those of the aperture 68 of the first unit 48. A first connecting element 86 is passed through the transverse hole 84 of the second unit 50 and the aperture 68 of the first unit 48 to connect the first unit 48 and the second unit 50. Moreover, the first connecting element 86, once positioned in the transverse hole 84 and the aperture 68, serves to guide and facilitate the sliding action of the second unit 50 relative to the first unit 48.

Preferably, a front portion of the main body 74 of the second unit 50 further includes an edge 88 to be pressed against the first transverse guiding groove 66*a* and the second transverse guiding groove 66*b* of the first unit 48. The edge 88 of the main body 74 of the second unit 50 includes a protruding portion 90 for indicating the displacement distance of the second unit 50 relative to the first unit 48. In addition, the first sidewall 76 of the second unit 50 includes a hanging hole 92, and the second sidewall 78 of the second unit 50 has a wall hole 94.

The engaging element 52 is connected to the second unit 50. The engaging element 52 has a main body 96, an engaging portion 98 located at a lateral side of the main body 96, an elastic arm 100 located at the opposite lateral side of the main body 96, and a slot 102 in the main body 96. In one preferred embodiment, the engaging element 52 is pivotally connected to the second unit 50 via a second connecting element 104. Thus, when subjected to a rotating force, the engaging element 52 can be pivoted relative to the second unit 50 by a predetermined angle.

Figure 11B:
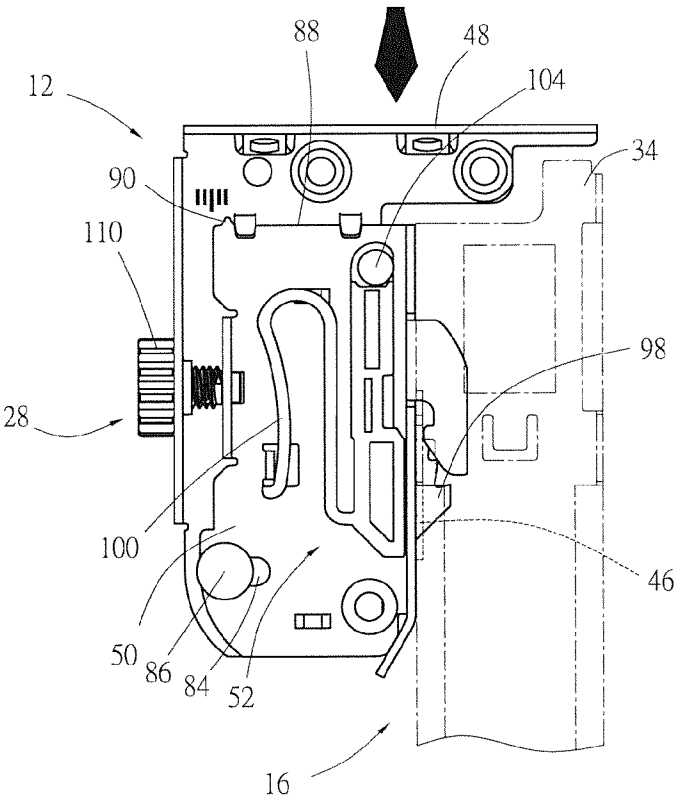
FIG. 11*b* is a schematic drawing in which the adjusting portion of the adjusting element has been adjusted, allowing the engaging portion of the engaging element of the front connecting device to be mounted in the mounting hole in the second rail of the slide rail assembly.

At least a portion of the engaging portion 98 is located and mounted in the mounting hole 46 of the second rail 34 (as can be seen more clearly in FIG. 11*b*). More specifically, when the engaging element 52 is pivotally connected to the main body 74 of the second unit 50, the engaging portion 98 of the engaging element 52 corresponds in position to the wall hole 94 in the second sidewall 78 of the second unit 50 and can be adjusted in position by means of the adjusting element 28. The engaging portion 98 of the engaging element 52, once extending through the wall hole 94 of the second unit 50, can be engaged in the mounting hole 46 of the second rail 34 to connect the first front connecting device 12 to the second rail 34.

In one preferred embodiment, the engaging portion 98 of the engaging element 52 has a step-like structure to adapt to mounting errors between the first front connecting device 12 and the mounting hole 46 of the second rail 34. For example, if a first mounting error (or a first distance error) exists between the engaging portion 98 of the engaging element 52 and the mounting hole 46 of the second rail 34, the first front connecting device 12 can be mounted in the mounting hole 46 of the second rail 34 via a first stage of the step-like structure. Similarly, if a second mounting error (or a second distance error) exists between the engaging portion 98 of the engaging element 52 and the mounting hole 46 of the second rail 34, the first front connecting device 12 can be mounted in the mounting hole 46 of the second rail 34 via a second stage of the step-like structure. It should be understood, however, that the engaging portion 98 of the engaging element 52 may adapt to the mounting errors between the first front connecting device 12 and the mounting hole 46 of the second rail 34 in ways other than described above. The elastic arm 100 extends from a portion of the main body 96 of the engaging element 52 and is located on the lateral side of the main body 96 that is opposite the engaging portion 98. The elastic arm 100 is generally U-shaped and has an end portion to contact against the second unit 50.

The disengaging element 54 is pivotally connected to the main body 74 of the second unit 50 via a third connecting element 106. The disengaging element 54 has a disengaging portion 108 located in the slot 102 of the main body 96 of the engaging element 52. The disengaging portion 108 is substantially an elliptic cylinder (but is not limited thereto) and is in contact with the wall surface of the slot 102.

The adjusting element 28 has an adjusting portion 110 and a screw rod 112. The screw rod 112 is connected to the first unit 48 and the second unit 50. More specifically, the screw rod 112 of the adjusting element 28 is threadedly connected to the threaded hole 72 of the first unit 48, and the second unit 50 hangs on the neck 114 of the screw rod 112 via the hanging hole 92.

Referring to FIG. 10*a* and FIG. 10*b*, the first unit 48 is marked with a plurality of characteristic marks, including a first characteristic mark K1, a second characteristic mark K2, a third characteristic mark K3, a fourth characteristic mark K4, and a fifth characteristic mark K5. If a mounting error S1 (distance error) exceeding an allowable range exists between the engaging portion 98 of the engaging element 52 of the first front connecting device 12 and the mounting hole 46 of the second rail 34 of the first slide rail assembly 16 (at which time the protruding portion 90 of the second unit 50 is located at the third characteristic mark K3, indicating a first position of the second unit 50), the engaging portion 98 of the engaging element 52 of the first front connecting device 12 cannot extend, let alone be mounted, into the mounting hole 46 of the second rail 34 of the first slide rail assembly 16 without the operator rotating the adjusting portion 110 of the adjusting element 28. In other words, unless the adjusting portion 110 of the adjusting element 28 is rotated, the first front connecting device 12 in this position cannot be connected to the second rail 34 of the first slide rail assembly 16.

Figure 11A:
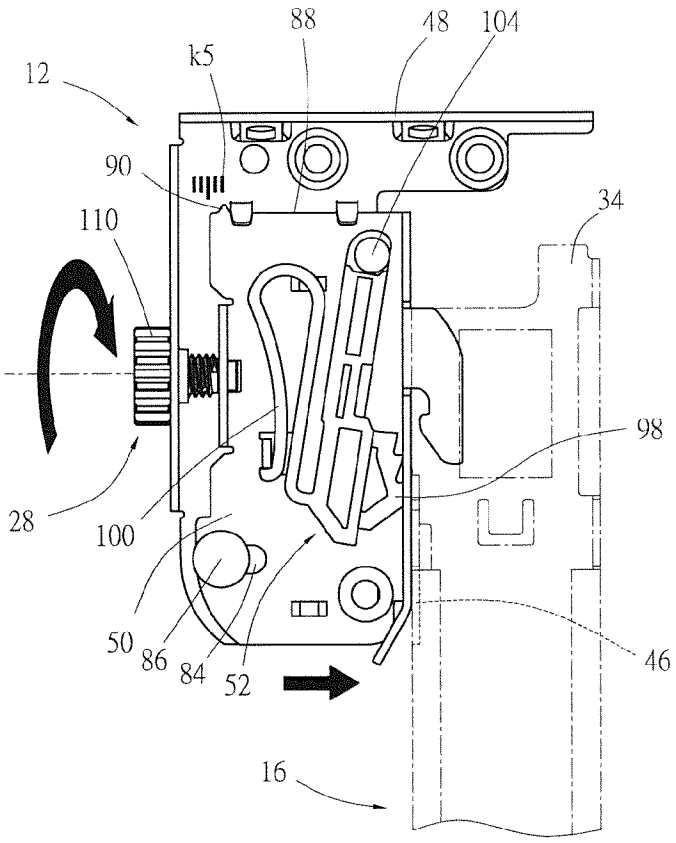
FIG. 11*a* is a schematic drawing in which the adjusting portion of the adjusting element has been adjusted to adjust the distance between the second unit and the second rail of the slide rail assembly.

With reference to FIG. 11*a*, when the adjusting portion 110 of the adjusting element 28 is rotated, the second unit 50 is displaced relative to the second rail 34 of the first slide rail assembly 16. As the engaging element 52 is connected to the second unit 50, the distance between the engaging portion 98 of the engaging element 52 and the mounting hole 46 of the second rail 34 is adjusted with the displacement of the second unit 50. More specifically, when the adjusting portion 110 of the adjusting element 28 is rotated (at which time the protruding portion 90 of the second unit 50 is displaced from the third characteristic mark K3 to the fifth characteristic mark K5, meaning that the second unit 50 is moved from the first position to a second position), the second unit 50 is displaced stably toward the first slide rail assembly 16 due to, referring back to FIG. 9, the guiding relationships between the first protruding block 82*a* of the second unit 50 and the first transverse guiding hole 64*a* of the first unit 48, the guiding relationship between the second protruding block 82*b* of the second unit 50 and the second transverse guiding hole 64*b* of the first unit 48, the guiding relationship between the first connecting element 86 and the transverse hole 84, and the guiding relationship between the edge 88 of the second unit 50 and the first and second transverse guiding grooves 66*a*, 66*b* of the first unit 48. When displaced along with the second unit 50, the engaging portion 98 of the engaging element 52 is first pressed against a sidewall of the second rail 34 of the first slide rail assembly 16. As a result, the engaging element 52 is pivoted by the predetermined angle due to the second connecting element 104. In the meantime, the elastic arm 100 of the engaging element 52 is compressed and stores an elastic energy.

Referring to FIG. 11*b*, when the first front connecting device 12 is further moved such that the engaging portion 98 of the engaging element 52 corresponds in position to the mounting hole 46 of the second rail 34 of the first slide rail assembly 16, the elastic energy stored in the elastic arm 100 is released, and the engaging portion 98 of the engaging element 52 springs into and is thereby mounted in the mounting hole 46 of the second rail 34. Thus, the problem associated with the mounting error S1 is solved, allowing the first front connecting device 12 to be securely connected to the second rail 34 of the first slide rail assembly 16.

As shown in FIG. 11*a* and FIG. 11*b*, once the second unit 50 is displaced relative to the second rail 34 of the first slide rail assembly 16 in response to the rotation of the adjusting portion 110 of the adjusting element 28, the engaging portion 98 of the engaging element 52 can be displaced relative to the mounting hole 46 of the second rail 34 of the first slide rail assembly 16.

Figure 12B:
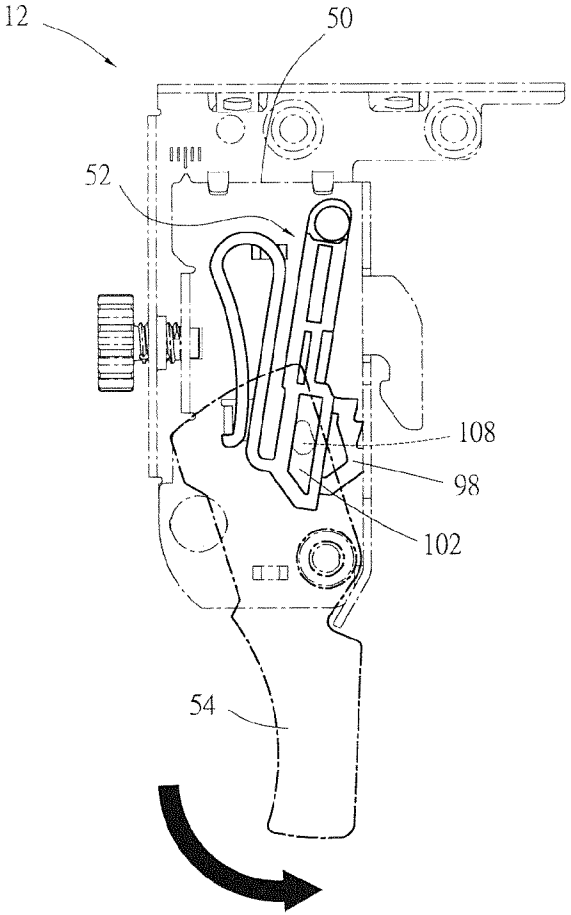
FIG. 12*b* is a schematic drawing in which the disengaging element in FIG. 12*a* has been adjusted such that the engaging element is pivoted by a predetermined angle.
Figure 12A:
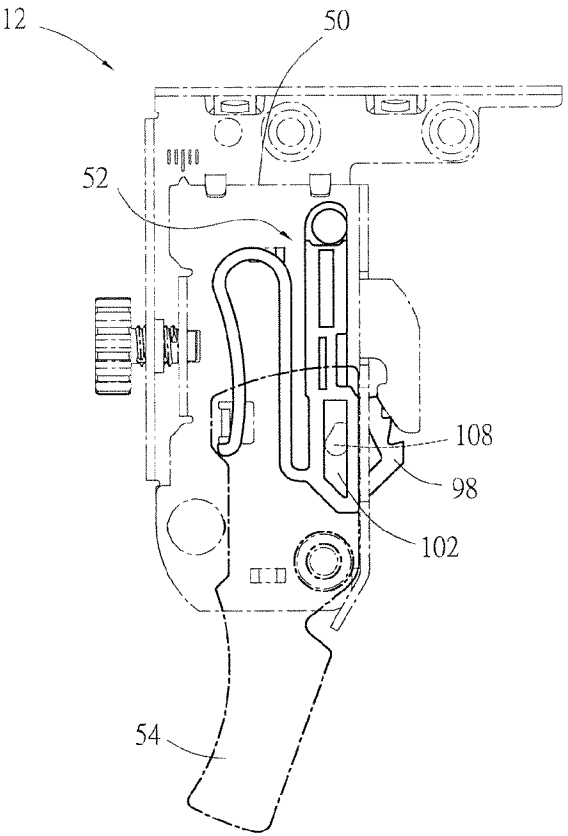
FIG. 12*a* is a schematic drawing in which the disengaging element of the front connecting device has yet to be adjusted.

Referring to FIG. 12*a* and FIG. 12*b*, when it is desired to remove the engaging portion 98 of the engaging element 52 from the position shown in FIG. 11*b*, i.e., from the mounting hole 46 of the second rail 34 of the first slide rail assembly 16, the operator only has to pivot the disengaging element 54 in such a way that the disengaging portion 108 of the disengaging element 54 is rotated and pressed against the wall surface of the slot 102 of the engaging element 52, and the disengaging portion 108 will pivot the engaging element 52 by the predetermined angle by means of the wall surface of the slot 102, allowing the engaging portion 98 of the engaging element 52 to displace relative to the second rail 34 and separate from the mounting hole 46 of the second rail 34 (FIG. 12*b* showing the engaging portion 98 of the engaging element 52 retracted into the second unit 50 after being rotated). Thus, the connection between the first front connecting device 12 and the second rail 34 of the first slide rail assembly 16 is cut off.

While the present invention has been disclosed through the foregoing preferred embodiments, it is understood that the embodiments are not intended to restrict the scope of the present invention. The scope of the present invention is defined by the appended claims.

The invention claimed is:

1. A slide rail system comprising:

a slide rail assembly comprising:

a first rail having a longitudinally extending main body; and a second rail longitudinally slidable relative to the first rail, the second rail having a longitudinally extending main body, and a rear portion; and a rear connecting device located at the rear portion of the second rail, the rear connecting device comprising:

a main body comprising a supporting portion and a transverse portion substantially perpendicularly connected to the supporting portion;

a locking element pivotally connected to the supporting portion of the main body, the locking element comprising a head and a locking rod connected to the head, the locking rod having a contact portion; and a movable element movably provided between the main body and the locking element, the movable element comprising a first plate portion and a second plate portion substantially perpendicular to the first plate portion;

wherein when the head of the locking element is rotated to a first position, the contact portion of the locking rod is pressed against the first plate portion of the movable element such that the movable element is positioned on the main body; and wherein once the head of the locking element is rotated from the first position to a second position, the contact portion of the locking rod is no more pressed against the first plate portion of the movable element, and the movable element is therefore allowed to be displaced relative to the main body.

2. The slide rail system of claim 1, wherein the supporting portion of the main body comprises a first vertical wall and a second vertical wall, the transverse portion of the main body has two opposite lateral sides respectively and substantially perpendicularly connected to the first vertical wall and the second vertical wall, each of the first vertical wall and the second vertical wall has a through hole, the through holes corresponding in position to each other, the locking rod of the locking element extends through the through holes of the first vertical wall and the second vertical wall, and the movable element has a width less than a width between the first vertical wall and the second vertical wall so that the movable element is displaceable between the first vertical wall and the second vertical wall.

3. The slide rail system of claim 1, wherein the transverse portion of the main body comprises a plurality of fixing portions arranged at intervals; the first plate portion of the movable element comprises a fixing portion corresponding in position to one of the fixing portions of the transverse portion of the main body; when the head of the locking element is rotated to the first position, the contact portion of the locking rod is pressed against the first plate portion of the movable element such that the fixing portion of the first plate portion of the movable element is engaged with one of the fixing portions of the transverse portion of the main body; and once the head of the locking element is rotated from the first position to the second position, the contact portion of the locking rod is no more pressed against the first plate portion of the movable element, and the fixing portion of the first plate portion of the movable element is therefore disengaged from the one of the fixing portions of the transverse portion of the main body.

4. The slide rail system of claim 1, wherein the second rail further has a front portion opposite the rear portion and has a mounting hole adjacent to the front portion, and wherein the slide rail system further comprises a front connecting device, the front connecting device comprising:

a first unit having at least one transverse guiding portion;

a second unit having at least one transverse guiding portion located at the transverse guiding portion of the first unit;

an engaging element connected to the second unit, the engaging element having an engaging portion at least partially located in the mounting hole of the second rail; and an adjusting element having an adjusting portion and a screw rod, the screw rod being connected to the first unit and the second unit;

wherein the second unit is displaceable relative to the second rail in response to rotation of the adjusting portion of the adjusting element, thereby enabling displacement of the engaging portion of the engaging element relative to the mounting hole of the second rail.

5. The slide rail system of claim 4, wherein the second unit further comprises a first sidewall having a hanging hole; the first unit further comprises a sidewall having a threaded hole, the screw rod of the adjusting element being threadedly connected to the threaded hole while the second unit hangs on a neck of the screw rod via the hanging hole; and the second unit further comprises a second sidewall opposite the first sidewall, the second sidewall having a wall hole, the engaging portion of the engaging element corresponding in position to the wall hole.

6. The slide rail system of claim 4, wherein the engaging element further comprises an elastic arm, and when the adjusting portion of the adjusting element is rotated, the second unit is displaced relative to the second rail, the engaging portion of the engaging element if not yet corresponding in position to the mounting hole of the second rail is pressed against a sidewall of the second rail and pivoted by a predetermined angle such that the elastic arm stores an elastic energy, and the engaging portion of the engaging element, once corresponding in position to the mounting hole, enters the mounting hole due to the elastic energy released by the elastic arm; and wherein the engaging element further comprises a slot, the front connecting device further comprises a disengaging element pivotally connected to the second unit, the disengaging element having a disengaging portion located in the slot, and when the disengaging element is pivoted, the disengaging portion of the disengaging element drives the engaging element via the slot and thereby pivots the engaging element such that the engaging portion of the engaging element is displaced relative to the second rail and separates from the mounting hole.

7. A connecting device, comprising;

a main body comprising a supporting portion and a transverse portion substantially perpendicularly connected to the supporting portion;

a locking element pivotally connected to the supporting portion of the main body, the locking element comprising a head and a locking rod connected to the head, the locking rod having a contact portion; and a movable element movably provided between the main body and the locking element, the movable element comprising a first plate portion and a second plate portion substantially perpendicular to the first plate portion;

wherein when the head of the locking element is rotated to a first position, the contact portion of the locking rod is pressed against the first plate portion of the movable element such that the movable element is positioned on the main body; and wherein once the head of the locking element is rotated from the first position to a second position, the contact portion of the locking rod is no more pressed against the first plate portion of the movable element, and the movable element is therefore allowed to be displaced relative to the main body.

8. The connecting device of claim 7, wherein the supporting portion of the main body comprises a first vertical wall and a second vertical wall, the transverse portion of the main body has two opposite lateral sides respectively and substantially perpendicularly connected to the first vertical wall and the second vertical wall, each of the first vertical wall and the second vertical wall has a through hole, the through holes corresponding in position to each other, the locking rod of the locking element extends through the through holes of the first vertical wall and the second vertical wall, and the movable element has a width less than a width between the first vertical wall and the second vertical wall so that the movable element is displaceable between the first vertical wall and the second vertical wall.

9. The connecting device of claim 7, wherein the transverse portion of the main body comprises a plurality of fixing portions arranged at intervals; the first plate portion of the movable element comprises a fixing portion corresponding in position to one of the fixing portions of the transverse portion of the main body; when the head of the locking element is rotated to the first position, the contact portion of the locking rod is pressed against the first plate portion of the movable element such that the fixing portion of the first plate portion of the movable element is engaged with one of the fixing portions of the transverse portion of the main body; and once the head of the locking element is rotated from the first position to the second position, the contact portion of the locking rod is no more pressed against the first plate portion of the movable element, and the fixing portion of the first plate portion of the movable element is therefore disengaged from the one of the fixing portions of the transverse portion of the main body.

* * * * *